United States Patent [19]

Coulombe

[11] 4,123,984

[45] Nov. 7, 1978

[54] THREAD TENSION DISCS

[75] Inventor: Lionel J. Coulombe, Matawan, N.J.

[73] Assignee: The Singer Company, Elizabeth, N.J.

[21] Appl. No.: 823,244

[22] Filed: Aug. 10, 1977

[51] Int. Cl.[2] ..... D05B 47/04

[52] U.S. Cl. ..... 112/254

[58] Field of Search ..... 112/254, 255; 242/150

[56] References Cited

U.S. PATENT DOCUMENTS 3,978,802 9/1976 Hamlett ..... 112/254

FOREIGN PATENT DOCUMENTS 2,157,016 5/1973 Fed. Rep. of Germany ..... 112/254

*Primary Examiner*—George H. Krizmanich

*Attorney, Agent, or Firm*—Robert E. Smith; Edward L. Bell; William V. Ebs

[57] ABSTRACT

Thread tension discs for sewing machine thread tension devices which urge thread in toward the center of the device. Complimental indentations in the surface of the discs at the point of entry of thread into the device so change the angle of the edge of the discs at the point of entry that the thread has a tendency to work its way into as opposed to out of the device.

3 Claims, 4 Drawing Figures

THREAD TENSION DISCS

BACKGROUND OF THE INVENTION

This invention relates to tension devices for sewing machines, and in particular, to those devices utilizing tension discs for providing thread tension.

There are many types of tension devices used to control thread on sewing machines. A large quantity of these devices utilized freely rotatable tension discs which are pressed together by an adjustable spring force, resulting in a controled drag exerted on thread passing therebetween. However, under low tension conditions, with these devices, the thread has a tendency to work its way out of the device.

SUMMARY OF THE INVENTION

The object of this invention is to provide a tension device wherein thread passing therethrough tends to work itself into, as opposed to out of, the device. This object is achieved by changing the edge angle of the tension discs at the point of entry of thread. Indentations are made in the surface of two opposing tension discs at the periphery thereof. These indentations so change the edge angle of the tension discs that the thread, while being drawn through the device, tends toward the center thereof.

A further object of this invention is to provide tension discs, as described above, which are identical thereby alleviating the need to manufacture both a left and right disc.

With the above and additional objects and advantages in view as will hereinafter appear, this invention will be described with reference to the drawing of the perferred embodiment.

DESCRIPTION OF THE PERFERRED EMBODIMENT

Figure 2:
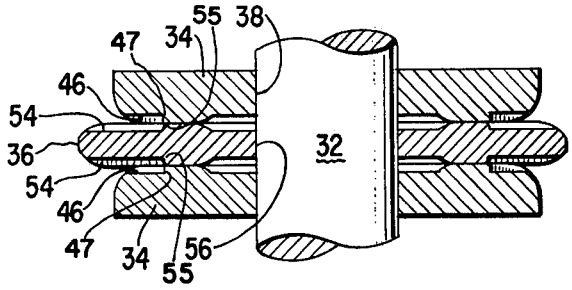
FIG. 2 is a cross-sectional view of the tension device taken along the line 2—2 of FIG. 1 showing the relationship of the indentations in the tension disc.
Figure 1:
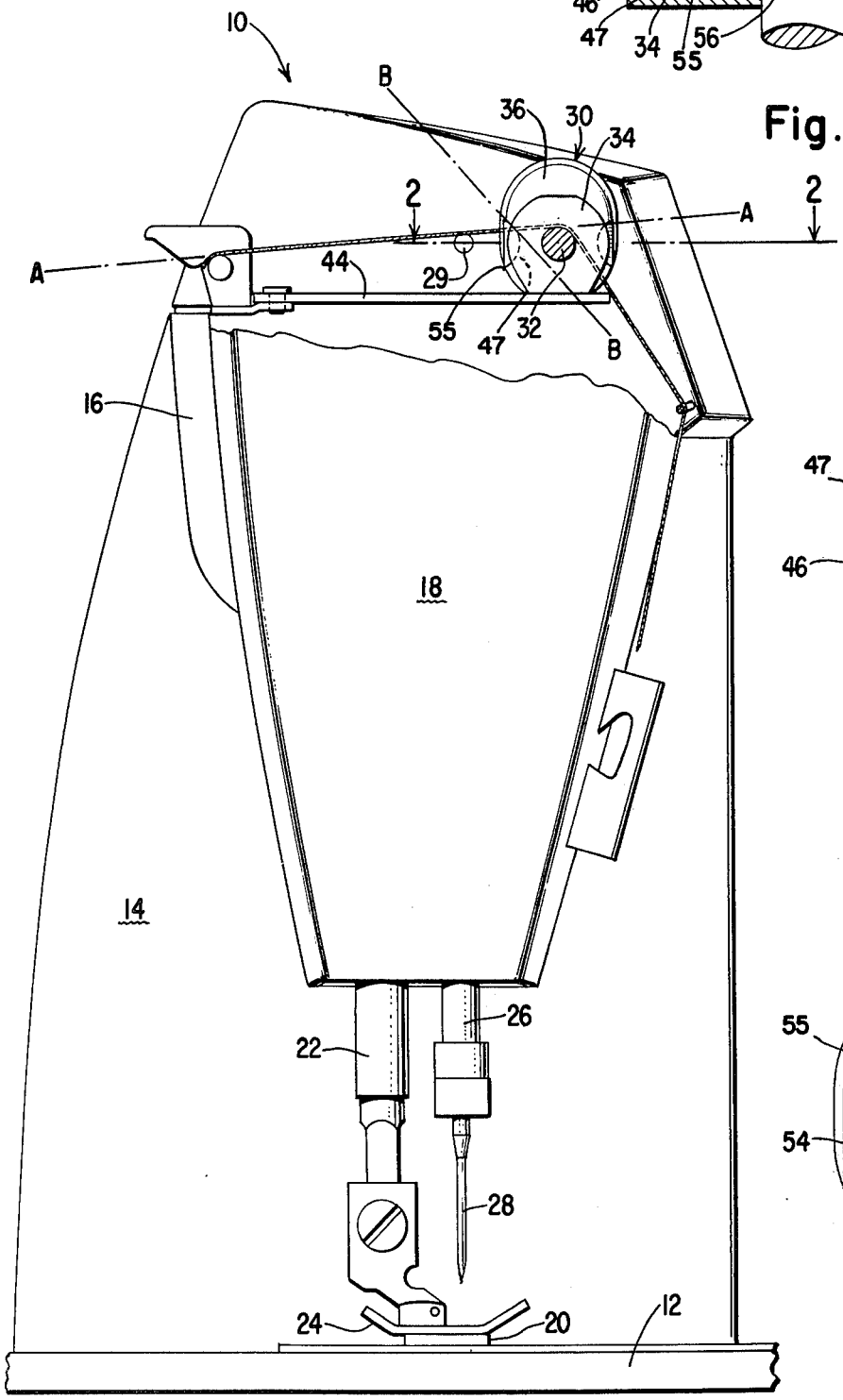
FIG. 1 is a side elevational view of a sewing machine, partly in section, showing the tension discs of this invention incorporated therein.
Figure 3:
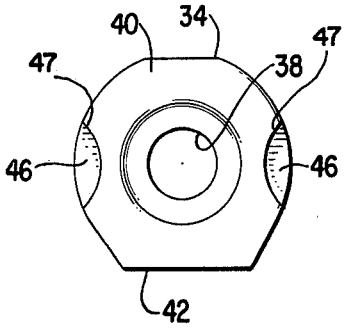
FIG. 3 is a plan view of the small tension disc.
Figure 4:
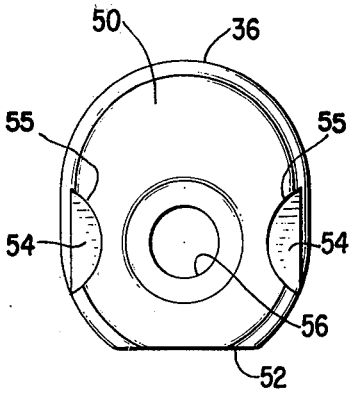
FIG. 4 is a plan view of the large two-sided tension disc.

In FIG. 1 a sewing machine is generally referred to by the reference number 10. The sewing machine 10 includes a bed 12, a standard 14 rising fron the bed 12, and a bracket arm 16 extending from the standard 14 and overhanging the bed 12, and terminating in a sewing head 18. Included in the bed 12 is a feed mechanism of which a feed dog 20 is illustrated for progressively moving the material being sewn.

Included within the sewing head 18 is a downwardly biased presser bar 22 to the end of which is carried a presser foot 24 for urging the material into engagement with the feed dog 20. A needle bar 26 is arranged within the sewing head 18 for endwise reciprocation. A thread carrying needle 28 is clamped to the end of the needle bar 26 for penetrating the material being sewn in the formation of stitches. Also carried within the sewing head 18 is a thread guide 29 and a tension device 30 for controlling thread which is supplied to the thread carrying needle 28.

The tension device 30 includes a central shaft 32 on which is carried two identical tension discs 34 and a central dividing disc 36 which is substantially larger then the tension discs 34, and means (not shown) for providing a compressive force between the discs. The tension discs 34 are each formed with a centrally located hole 38 therethrough for mounting and a raised thread bearing surface 40 on one side thereof against which thread is pressed. The edge of each tension disc 34 is formed with a flat area 42 arranged to abut a frame 44 mounted within the sewing machine head 18 in order to prevent the tension discs 34 from rotating.

Each of the tension discs 34 is symmetrically formed with two diametrically opposed indentations 46 intersecting the thread bearing surface 40 along edge 47.

The central dividing disc 36 is similarly formed with thread bearing surfaces 50 on both sides thereof, a flat area 52 along the edge, indentations 54, as in the tension discs 34, but on both sides thereof, and a centrally located mounting hole 56. The indentations 54 on the central disc 36, which intersect the thread bearing surfaces 50 along edge 55, are so positioned that they will be arranged in alignment with the indentations 46 on the tension discs 34 when the discs 34 and 36 are mounted on a common shaft 32.

In operation, when thread is drawn between either the tension discs 34 alone or between one of the tension discs 34 and the central dividing disc 36, due to the angle of entry of the thread with the edge of the raised thread bearing surfaces 40 and 50 modified by indentations 46 anf 54, respectively, the thread will have a tendency to move in toward the center of the tension device 30 as opposed to out of the same. Also, since tension discs 34 are identical as well as symmetrical, there is no need to manufacture distinct left and right discs.

As indicated in FIG. 1, thread guide 29 and the central shaft 32 define a normal thread path A—A into the tension device 30. The line B—B indicates the tangent to the curve of the edges 47 and 55 at the point of intersection with the thread path A—A. Since the angle of edges 47 and 55, as illustrated by line B—B, is downward, toward the central shaft 32, at the point of intersection with the thread path A—A, thread entering the tension device 30, in seeking the path of least resistance, will be urged downward into further engagement with the tension device 30; note that without the indentations 46 and 54, the slope of B—B would be upward thereby urging the thread away from the central shaft 32.

While in this embodiment, indentations have been used to achieve the desirable edge angle, from the foregoing discussion it should be understood that the desired results are due to the slope of B—B, and the same results may be effected by a change in the geometric shape of the tension discs such that the slope of the edge at the point of entry will urge thread into further engagement.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what I herein claim is:

1. An improved thread tension device for controlling thread on a sewing machine having means for applying tension to the thread passing therethrough, wherein the improvement comprises: at least two tension discs each having a thread bearing surface formed thereon, said thread bearing surfaces of said tension discs being formed with a pair of mating peripheral indentations, said indentations being so located as will intersect the point of entry of thread into said tension device whereby the thread will be urged toward the center of said tension device as the thread is drawn therethrough; and means for preventing the rotation of said tension discs.

2. A tension device as set forth in claim 1 which further comprises the thread bearing surfaces of said tension discs being formed with a second pair of mating indentations located diametrically opposite said other pair of indentations thereby allowing said tension discs to be identical for use as either a right or left tension disc in said tension device.

3. A tension device as set forth in claim 1 wherein said means for preventing rotation of said tension discs comprises said tension discs being formed with a flat area in the circumference thereof and a frame on which said tension discs are mounted, said frame having a portion thereof abutting the flat areas of said tension discs thereby preventing said tension discs from rotating.

* * * * *

UNITED STATES PATENT OFFICE

CERTIFICATE OF CORRECTION

PATENT NO. : 4,123,984

DATED : November 7, 1978

INVENTOR(S) : Lionel J. Coulombe

It is certified that error appears in the above-identified patent and that said Letters Patent are hereby corrected as shown below:

Column 4, Claim 3, line 8, delete "1" and insert -- 2 --

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*